US008323740B2

(12) United States Patent
Forak et al.

(10) Patent No.: US 8,323,740 B2
(45) Date of Patent: Dec. 4, 2012

(54) PRESHRUNK SOLID HARDWOOD FLOOR

(76) Inventors: Victor Forak, Chantilly, VA (US); Alexei Forak, Chantilly, VA (US)

( * ) Notice: Subject to any disclaimer, the term of this patent is extended or adjusted under 35 U.S.C. 154(b) by 1425 days.

(21) Appl. No.: 11/656,923

(22) Filed: Jan. 23, 2007

(65) Prior Publication Data

US 2007/0224353 A1 Sep. 27, 2007

Related U.S. Application Data

(60) Provisional application No. 60/785,802, filed on Mar. 24, 2006.

(51) Int. Cl.
*B05D 3/02* (2006.01)

(52) U.S. Cl. ..... 427/317; 427/408

(58) Field of Classification Search ..... 427/317
See application file for complete search history.

(56) References Cited

U.S. PATENT DOCUMENTS

| | | | | |
|---|---|---|---|---|
| 3,404,502 | A * | 10/1968 | Miller | 52/316 |
| 4,644,720 | A * | 2/1987 | Schneider | 52/392 |
| 6,148,884 | A * | 11/2000 | Bolyard et al. | 144/369 |
| 2004/0031225 | A1 | 2/2004 | Fowler | |
| 2005/0013939 | A1 * | 1/2005 | Vinden et al. | 427/325 |

* cited by examiner

*Primary Examiner* — Timothy Meeks
*Assistant Examiner* — Nathan T Leong
(74) *Attorney, Agent, or Firm* — James Ray & Assoc.

(57) ABSTRACT

A process for producing preshrunk hardwood floors. The process comprises the steps of selecting untreated hardwood flooring having a predetermined thickness and a predetermined width and then placing such untreated hardwood flooring in a drying kiln. Another step is operating the drying kiln for a predetermined time at a predetermined temperature in order to remove moisture from the hardwood flooring and then determining one of the moisture remaining in the hardwood flooring or the moisture that was lost during the operation of the drying kiln. Another step is removing the hardwood flooring that was dried in the drying kiln in the previous steps. This is followed by sealing the pores of the hardwood flooring, while the wood is still hot, that was kiln dried in the previous steps, with a sealer.

10 Claims, 4 Drawing Sheets

PRESHRUNK SOLID HARDWOOD FLOOR

CROSS REFERENCE TO RELATED APPLICATIONS

This application is closely related to and claims benefit from U.S. Provisional Application Ser. No. 60/785,802 filed Mar. 24, 2006.

FIELD OF THE INVENTION

The present invention relates, in general, to hardwood floors, and, more particularly, the present invention relates to a preshrunk solid hardwood floors in which the moisture content has been controlled and the flooring sealed prior to installation.

BACKGROUND OF THE INVENTION

Any article made of wood is subject to expansion and contraction resulting from changes in humidity. Wood is a hygroscopic material, which means it will absorb moisture in a wet environment and give off moisture in a dry environment until the wood reaches an equilibrium. Approximately a 1% dimension change takes place with each 3% change in the moisture content of the wood. This applies to hardwood more so than soft wood. So the environment that wood is exposed to has a great deal to do with the amount of moisture in the wood. Air can hold a certain amount of moisture at a given temperature when it is saturated. Relative humidity expresses what the air is actually holding compared to what it would hold if the air were saturated. Temperature is important since warm air can hold more moisture than cold air.

Freshly cut trees have a high moisture content. Wood cut from these trees generally will lose much of the moisture as the wood is being processed. Although wood can be brought to a point of relative stability, this does not mean that the wood will not change. In the summer when the air has relatively high moisture content wood will absorb moisture, whereas in the winter with low moisture contents wood will lose moisture. This loss of moisture is particularly true in centrally heated houses where the moisture contents tends to quite low.

Often these changes in the moisture content of hardwood floors that occur with changes in the moisture content of air will invariably lead to customer complaints. The result of these changes in moisture content can lead to unsightly gaps between the strips of hardwood, or to floors that creak, cup, buckle or shift and/or having cracks and splits in the flooring. When wood is exposed to air, the wood will dry or pick up moisture until it is in equilibrium with humidity and temperature of the air. Moisture absorption causes wood to swell unequally in a variety of directions. When it dries wood shrinks across the grain. This is true of all woods. It is also true that moisture absorption will cause wood to swell unequally, in a variety of directions. Another truth is that all wood will continue to expand or contract with changes in humidity no matter what you do to it (save shrink wrapping it in an air tight plastic wrapper).

Thus, it would be advantageous if there were a means available that would provide hardwood floors that would not be subject to absorption or loss of moisture because of the humidity and temperature variations that occur in the environment in which the wood is placed in.

SUMMARY OF THE INVENTION

In a first aspect the present invention provides a process for producing preshrunk hardwood floors. The process comprises the steps of placing untreated hardwood flooring having a predetermined thickness and a predetermined width such untreated hardwood flooring in a drying kiln. Another step is operating the drying kiln for a predetermined time at a predetermined temperature in order to remove moisture from the hardwood flooring. Establishing a desired residual moisture content for said hardwood flooring and then determining the moisture remaining in the hardwood flooring. Another step is removing the hardwood flooring that was dried in the drying kiln in the previous steps and found to have the desired residual moisture content. This is followed by sealing the pores of the hardwood flooring, while the wood is still hot, that was kiln dried in the previous steps, with a sealer.

OBJECTS OF THE INVENTION

It is, therefore, one of the primary objects of the present invention is to provide a process for pre-treating hardwood to prevent shrinking.

Another object of the present invention is to provide a process for pre-treating hardwood to prevent conditions that occur from moisture absorption.

Still another object of the present invention is to provide a process for pre-treating hardwood to allow the flooring endure beautifully for years.

Yet another object of the present invention is to provide a process for pre-treating hardwood that would be implemented and applied during manufacturing.

These and various other objects and advantages of this invention will become apparent after a full reading of the following detailed description, particularly, when read in conjunction with the attached drawings as described below and the appended claims.

Figure 1:
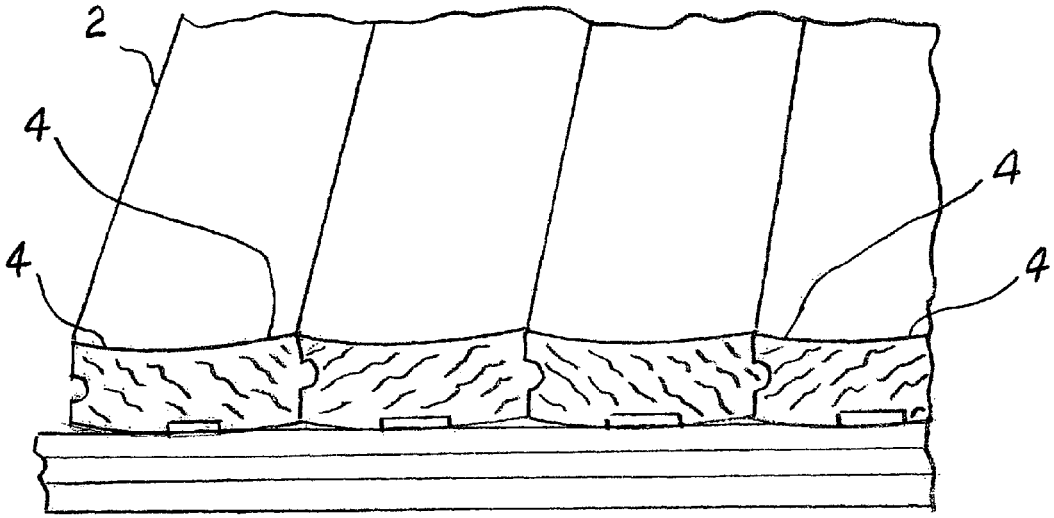
FIG. 1 is a perspective view of hardwood flooring illustrating cupping of hardwood flooring.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 2:
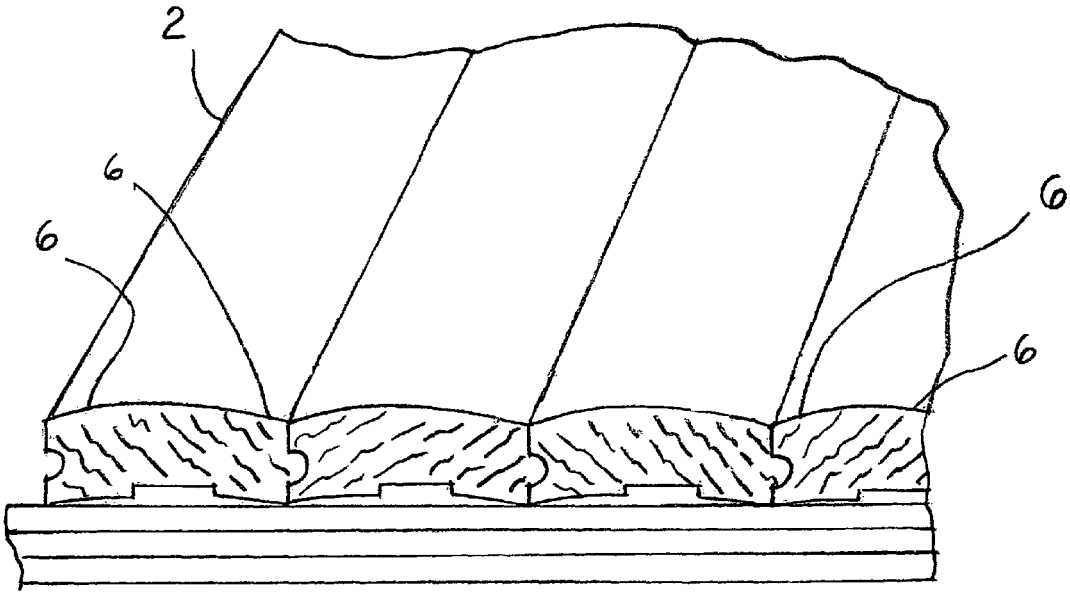
FIG. 2 is a perspective view of hardwood flooring illustrating a crowned effect on a hardwood floor.
Figure 3:
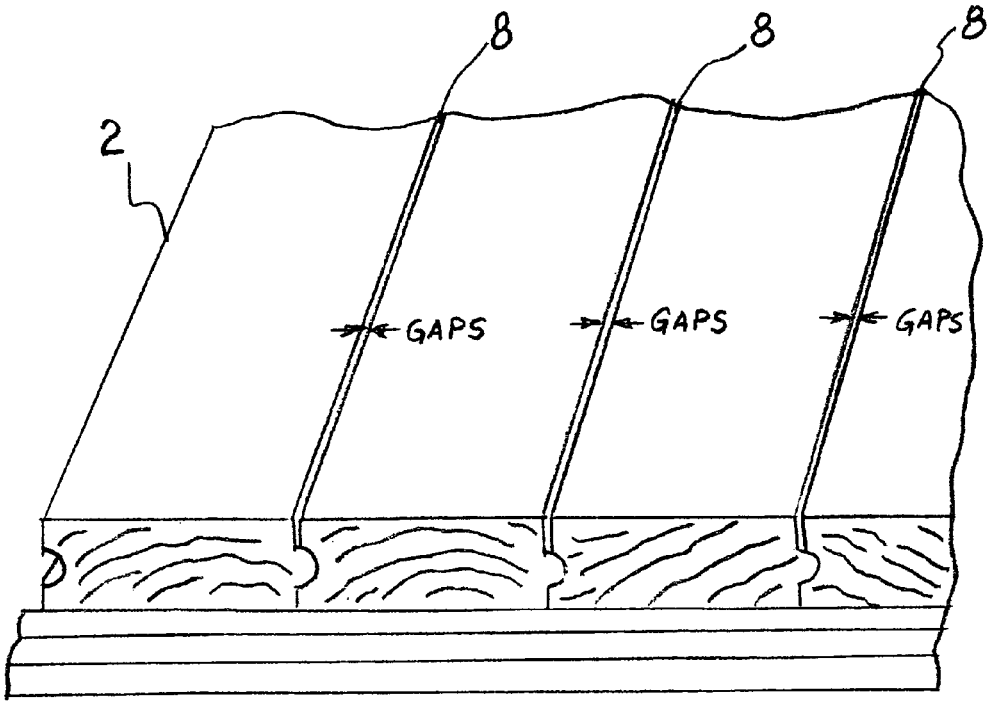
FIG. 3 is a perspective view of untreated hardwood flooring illustrating gaps that can be formed on the hardwood floor by the wood losing moisture from being in a dry environment.
Figure 4:
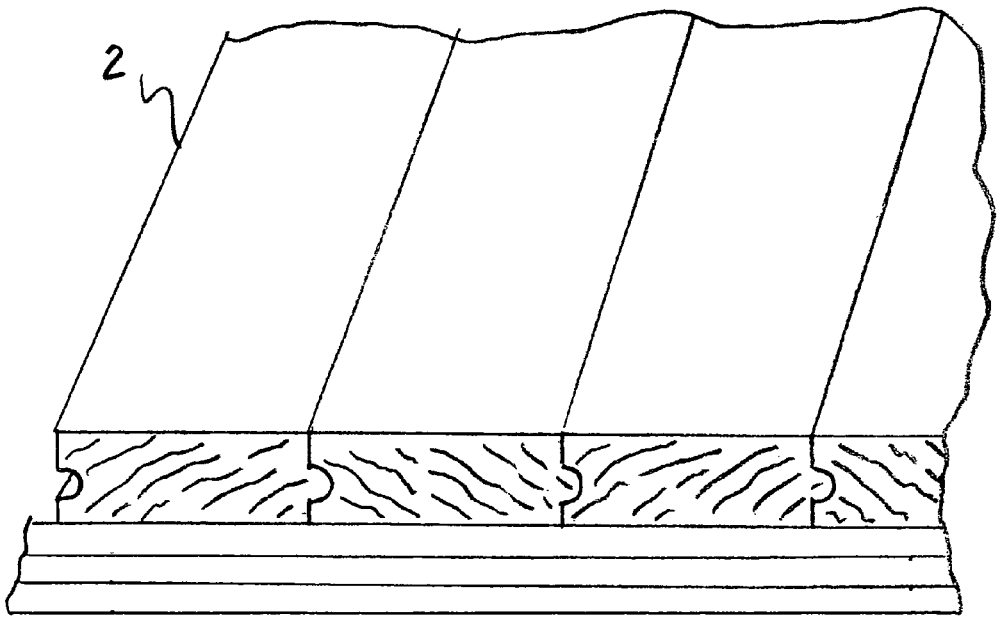
FIG. 4 is a perspective view of hardwood flooring illustrating treated preshrunk hardwood flooring that is free of stress.
Figure 5:
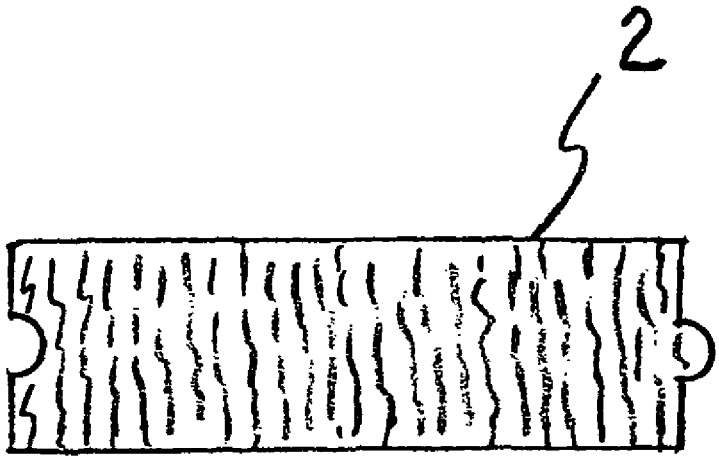
FIG. 5 is a perspective view of a board of hardwood flooring showing the open pores.
Figure 6:
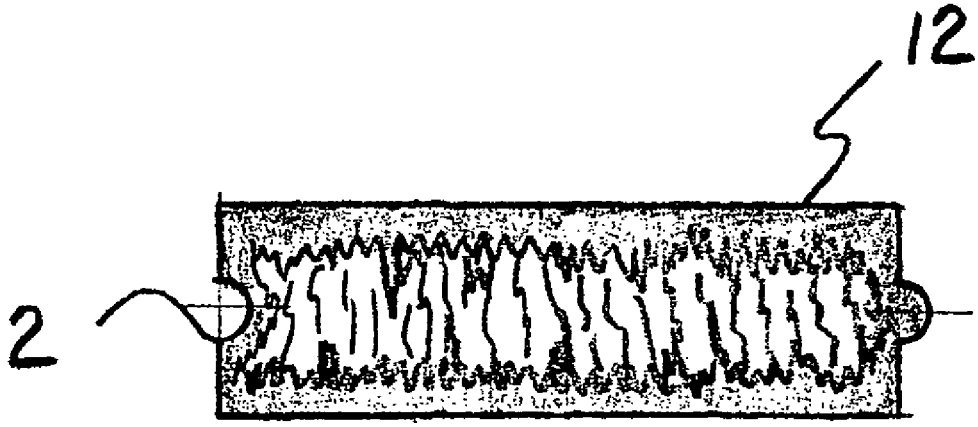
FIG. 6 is a perspective view of a board of preshrunk hardwood flooring that has been kiln dried and sealed.

Illustrated in FIGS. 1-3 are perspective views of hardwood flooring showing some flooring with problems while FIG. 4 shows a perspective view of flooring that was preshunk according to the present invention. The hardwood flooring 2 in FIG. 1 shows cupping 4 of the hardwood flooring because of swelling of the flooring due to moisture absorption. FIG. 2 illustrates hardwood flooring 2 that shows crowning 6 of such hardwood flooring, again as a result of absorption of moisture. FIG. 3 illustrates hardwood flooring 2 that has lost moisture and as a result there are gaps 8 between the boards of the flooring. Illustrated in FIG. 4 is hardwood flooring 2 that the was previously treated by the preshrunk treatment according to the present invention. FIG. 5 illustrates a board of untreated hardwood flooring 2 in which the pores are open and thus are susceptible to both moisture absorption and/or loss of moisture, while FIG. 6 illustrates a board of preshrunk hardwood flooring in which the exterior surface pores are sealed 12 with a sealer according to the present process.

The present invention provides a process, generally designated 10, for producing preshrunk hardwood floors 2. The process 10 comprises the steps of selecting untreated hardwood flooring 2 which has a predetermined thickness and a predetermined width and placing such untreated hardwood flooring in a drying kiln. The kiln is operated for a predetermined time at a predetermined temperature. A desired residual moisture content for such hardwood flooring is established. Another step involves determining the moisture remaining in the hardwood flooring 2 during the operation of the drying kiln. The hardwood flooring 2 that was dried in the previous steps is removed from the kiln when the residual moisture content of the hardwood is at the desired level. The next step is sealing the exterior surface pores of the hardwood flooring 2 that was kiln dried with a sealer 12. It is important that the sealer is applied while the pores are open and the wood is still hot from being dried in the drying kiln. Sealing is done to preserve the moisture content remaining in the hardwood flooring 2 which is at the desired level and to prevent the flooring from absorbing any additional moisture. The sealed hardwood flooring 2 is either sent to be packed for shipment as unfinished preshrunk hardwood flooring or is sent to an additional step of finishing such hardwood flooring. After which such flooring is sent to be packed for shipment as prefinished, preshrunk hardwood flooring.

The sealing process seals all exterior surface pores in such hardwood flooring 2 so as to preserve the desired moisture content remaining in such hardwood flooring and preventing such hardwood flooring from absorbing more moisture. Such sealer 12 can either be a water based, synthetic based or an oil based sealer 12.

The predetermined thickness of such hardwood flooring can be any one of ½ inch, ¾ inch and 1 inch and the predetermined width of such hardwood flooring could be any one of 1, 1¼, 1½, 2, 2¼, 2½, 3, 3¼, 3½, 4, 5, 6, 7, 8 or 9 inches.

Such preshrunk hardwood flooring prepared by the described process will produce hardwood flooring that has dimensional stability. Such flooring is provided with an equilibrium moisture content and thus will remain unaffected by changes in the environmental humidity in which the hardwood flooring will encounter. The same cannot be said for hardwood flooring that has not been treated by the present process as such wood will either absorb or lose moisture depending on the environmental conditions. Thus, the present invention provides a process of treating hardwood that would be implemented and applied during manufacturing. The process includes taking prefabricated hardwood floors and subjecting them to kiln drying camera for a predetermined period. This time is usually between 30 minutes to 1 hour. A kiln drying camera is a large oven where the amount of moisture removed from the wood can be controlled. The wood is left with a predetermined desired moisture content which is necessary. The next step is done so as to preserve the moisture content left in the wood by sealer camera. While the pores of the wood are still open and hot the pores are sealed by the sealer. By sealing the pores of the wood the predetermined moisture content of the wood is preserved and, further, the sealing fills the exterior pores entirely so as to prevent the wood from absorbing more moisture in the event that such hardwood would be placed in a humid environment. This ensures that the treated hardwood flooring, once installed, will never shrink, cup or buckle. This process is referred to as a "Moisture Minus" process.

Figure 7:
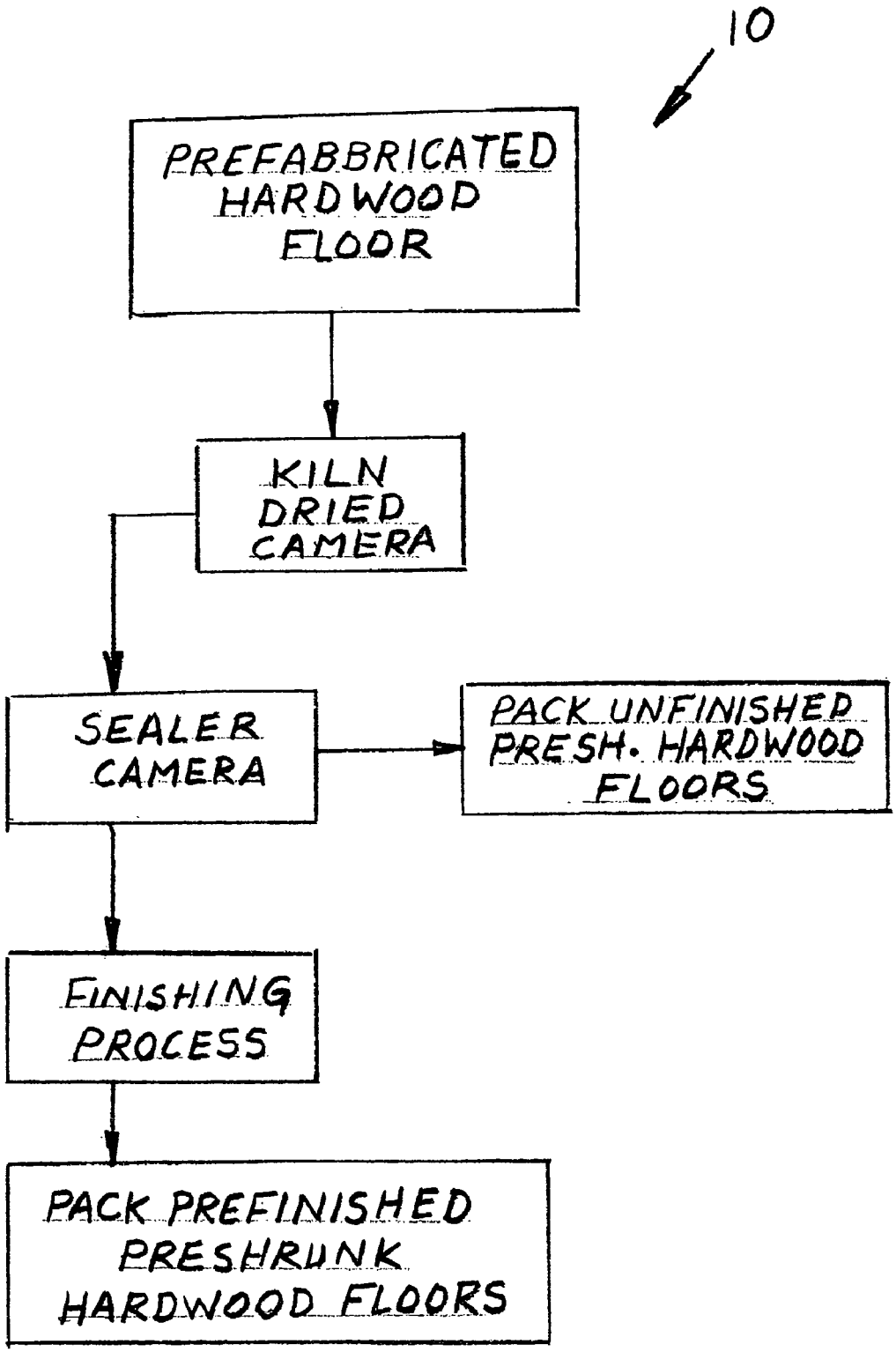
FIG. 7 is a block diagram showing the steps of the process.

FIG. 7 shows a block diagram of the process. It should be noted that the word "camera" as used in kiln drying camera or sealer camera refers to a chamber where the given action takes place. For example kiln dry camera or sealer camera could also be called kiln dry chamber or sealer chamber. Kiln dry is used to take the moisture out while sealer is used to seal the wood with a given percentage of moisture remaining in it (in other words to preserve the wood with a given amount of moisture).

After the wood is sealed the treated hardwood can be moved on to a finishing process or, if desired, the sealed wood can move to a step wherein the wood is packed as unfinished preshrunk hardwood floors. The wood that was moved to the finishing process is now ready to be packed as prefinished preshrunk hardwood floors.

This pre-treatment of hardwood floors is done to prevent the floors from shrinking, swelling or any other conditions that could occur from moisture absorption. Some of these conditions would be creaking, cupping, buckling, and possible cracks or splits in the flooring. The process provides permanent results which allow the hardwood floors to endure and remain beautiful for years. The flooring will remain perfectly flat, forever.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

We claim:

1. A process for producing preshrunk hardwood floors, said process comprising the steps of:

(a) placing untreated hardwood flooring having a predetermined thickness and a predetermined width in a drying kiln;

(b) operating said drying kiln for a predetermined time at a predetermined temperature for removing moisture from said hardwood flooring;

(c) establishing a predetermined desired residual moisture content for said hardwood flooring placed in said drying kiln in step (a);

(d) determining residual moisture content remaining in said hardwood flooring;

(e) removing said hardwood flooring that was dried in said drying kiln in steps (a, b) and having said desired predetermined moisture content determined in step (d); and (f) immediately thereafter sealing pores of said hardwood flooring that was kiln dried in steps (a,b) while the hardwood flooring is still hot from kiln drying and said pores are still open, said sealing includes all exterior surface pores in such hardwood flooring so as to preserve desired moisture content remaining in such hardwood flooring and preventing such hardwood flooring from absorbing more moisture.

2. The process, according to claim 1, wherein said process includes a step of packing for shipment unfinished preshrunk hardwood flooring previously sealed in step (f).

3. The process, according to claim 2, wherein said process further includes an additional step of finishing said preshrunk hardwood flooring sealed in step (f).

4. The process, according to claim 3, wherein said process further includes a step of packing for shipment said prefinished, preshrunk hardwood flooring.

5. The process, according to claim 1, wherein said drying kiln is used to control the amount of moisture removed from such hardwood.

6. The process, according to claim 1, wherein said sealer is one of an oil based sealer, a synthetic sealer and a water based sealer.

7. The process, according to claim 1, wherein said predetermined thickness of said hardwood flooring is one of ½ inch, ¾ inch and 1 inch.

8. The process, according to claim 1, wherein said predetermined width of said hardwood flooring is one of 1, 1¼, 1½, 2, 2¼, 2½, 3, 3¼, 3½, 4, 5, 6, 7, 8 and 9 inches.

9. The process, according to claim 1, wherein said preshrunk hardwood flooring has dimensional stability.

10. The process, according to claim 1, wherein said preshrunk hardwood flooring is provided with an equilibrium moisture content.

* * * * *